US008439221B2

(12) United States Patent
Davis

(10) Patent No.: US 8,439,221 B2
(45) Date of Patent: May 14, 2013

(54) BEVERAGE CONTAINER WITH CHILL SLEEVE

(75) Inventor: Troy M. Davis, Norristown, PA (US)

(73) Assignee: Troy M. Davis, Norristown, PA (US)

( * ) Notice: Subject to any disclaimer, the term of this patent is extended or adjusted under 35 U.S.C. 154(b) by 163 days.

(21) Appl. No.: 12/946,264

(22) Filed: Nov. 15, 2010

(65) Prior Publication Data

US 2012/0118897 A1 May 17, 2012

(51) Int. Cl.
*B65D 81/18* (2006.01)

(52) U.S. Cl.
USPC ..... 220/592.01; 62/457.3

(58) Field of Classification Search ..... 62/457.3, 62/530; 220/592.01
See application file for complete search history.

(56) References Cited

U.S. PATENT DOCUMENTS

| | | | | |
|---|---|---|---|---|
| 3,995,740 | A | 12/1976 | Amberg et al. | |
| 4,618,066 | A * | 10/1986 | Vail | 215/13.1 |
| 4,638,645 | A | 1/1987 | Simila | |
| 4,782,670 | A | 11/1988 | Long et al. | |
| 4,831,842 | A | 5/1989 | Kelley et al. | |
| 4,852,843 | A | 8/1989 | Chandler | |
| 4,981,022 | A * | 1/1991 | Snyder | 62/457.3 |
| 5,398,842 | A * | 3/1995 | Sokolski et al. | 220/630 |
| 5,406,808 | A | 4/1995 | Babb et al. | |
| 5,595,069 | A | 1/1997 | Gies | |
| 5,597,087 | A * | 1/1997 | Vinarsky | 220/482 |
| 5,607,076 | A | 3/1997 | Anthony | |
| 5,609,039 | A * | 3/1997 | Green et al. | 62/457.3 |
| 5,651,254 | A | 7/1997 | Berry | |
| 5,845,499 | A | 12/1998 | Montesanto | |
| 6,058,735 | A * | 5/2000 | Nathan | 62/530 |
| 6,870,135 | B2 | 3/2005 | Hamm et al. | |
| 7,287,656 | B2 * | 10/2007 | Guilford et al. | 215/11.1 |
| 7,543,717 | B2 * | 6/2009 | Hinkle | 220/508 |
| 2004/0139860 | A1 | 7/2004 | Hamm et al. | |
| 2005/0178777 | A1 | 8/2005 | Wiedermann | |
| 2005/0226965 | A1 | 10/2005 | Taylor | |
| 2007/0210090 | A1 | 9/2007 | Sixt et al. | |
| 2008/0006643 | A1 | 1/2008 | Ma | |
| 2008/0135564 | A1 | 6/2008 | Romero | |

* cited by examiner

*Primary Examiner* — Steven A. Reynolds
*Assistant Examiner* — King M Chu
(74) *Attorney, Agent, or Firm* — Paul & Paul

(57) ABSTRACT

A round beverage container with a chill sleeve is provided having a molded plastic wall in the shape of a cup, a mug, or a pitcher. A sleeve containing a chill medium is in the shape of a truncated conical cylinder, and is positioned in the container to be lodged therein at a selected mounting location and secured by snap-action sealing and retaining rings. A bottom disk, also containing the chill medium, snaps into the container's bottom edge to form the bottom of the container. This bottom disk is sealed to the inside wall of the container by snap-action sealing and retaining rings. Sonic welding can be employed as an alternative to sealing and securing rings. A quantity of water-based chill medium is metered into the hollow cavities when the sleeve and the bottom disk are charged, taking into consideration the expansion of the chill medium (water) upon a change of phase. The wall of the container is tapered and the side walls of the sleeve and of the bottom disk are each tapered to match the taper of the container wall. A bottom face (wall) for each of the insertable chill sleeve and the bottom disk is first separate from the remainder and then snapped into place to seal the respective chill sleeve and bottom disk after they are filled. The bottom face of the chill sleeve is toroidal-shaped.

20 Claims, 7 Drawing Sheets

BEVERAGE CONTAINER WITH CHILL SLEEVE

FIELD OF THE INVENTION

This invention is related to containers with pockets or inserts which can hold a frozen medium in order to chill the contents, or keep the contents of the container at or below a desired temperature.

BACKGROUND OF THE INVENTION

The maintaining of a chilled liquid in a cool state has been the object of various devices in the past. These devices have taken various design configurations. The first is an insulated cover which fits over a container which holds the liquid. The insulation retards heat transfer from the walls of the container surrounded by the insulation.

The second-type configuration includes an inner container for receiving a liquid holding container, such as a can or bottle, and an outer container spaced about and away from the inner container. The space between the inner and outer container walls receives and holds either a chilling agent or a heating agent.

A third-type configuration includes an outer container which may be made of insulation or of a rigid thermoplastic material, and an interior cooling container adhered to the inside face of the outer container. This cooling container can take several formats. A first cooling structure is defined by an insert with an inner and an outer wall with a cooling agent contained between. An insulation layer may exist between the outer wall of the insert and the ultimate outer wall of the outer container. The device is intended to receive a liquid holding container, such as a can or a bottle within the cooling insert.

A second cooling sleeve is defined by a flexible insert with plural cooling agent packets each holding a cooling agent. This flexible "blanket" is supported to line the inside wall of the outer container and to again receive a separate insertable liquid holding container, such as a can or a bottle.

A variation on this has been a cup surrounded by a flexible cooling "blanket", which in turn is surrounded by an insulation "blanket". With these variations, the insulation blanket is generally held in place by a fastener, which also permits its removal.

A fourth-type configuration includes a rigid double-walled mug with an insertable bottom. A space between the inner and outer wall receives a refrigerant or a chemical gel having chemically loaded freeze crystals. The refrigerant and/pr the chemical gel is charged into the space between the walls through a bottom plug hole. Because of the chemical nature of the freeze substance the inner and outer walls of the mug must be securely attached and permanently sealed at their ends where they meet, proximate the drinking lip of the mug. This requires that the walls of the mug be thick and inflexible (rigid). The bottom is sealed with a plug. These fourth-type configured mugs are usually not dishwasher nor microwave safe.

A drawback of all of the foregoing structures is that they are relatively large and bulky, and it is generally difficult to drink from the can, cup or bottle held in the cooling or heating structure. A further drawback of the foregoing double-walled structures, which are not intended to hold a can, cup or bottle, is that they are also bulky and relatively heavy and may be rendered unusable after being subjected to the heat of a dishwasher or microwave oven.

What is desired is an improvement to these structures which itself is in the shape of a cup, a mug, or a pitcher, and which uses a safe cooling material, such as frozen water.

An objective of the present invention is to provide a cooling beverage container with a chilling structure containing freezable water.

A second objective of this invention is to provide such a container with a chilling insert which insert has been precharged and sealed with the cooling material before it is positioned within the container.

Another objective of this invention is to provide the chilling insert with a permanent snap-in capability.

An additional objective of this invention is to provide easy access to the interior of the container for installing the chilling insert.

SUMMARY OF THE INVENTION

The objectives of this invention are realized in a thermoplastic beverage container which can be shaped as a glass, a mug, a cup or a pitcher. The container has a uniformly thick cylindrical wall which flares (tapers) outwardly from the top to the bottom, at an angle selected in the range of 3-5 degrees from the vertical. An internal chill sleeve, insert, is inserted through the open bottom of the cylinder wall. This chill sleeve insert is frustoconical-shaped, i.e., it is a truncated cone with the same taper angle as the container's cylindrical wall.

The sleeve insert is hollow walled with a closed, permanently sealed upper end (edge) and an open bottom. The sleeve bottom receives a snap-in toroidal-shaped closure. The sleeve hollow wall is filled (charged) with chilling fluid through its bottom opening and then the toroidal closure is snapped into place. The chilling fluid can be ordinary water, or distilled water, or water having a food-type additive. The volume of the fluid poured into the sleeve insert's hollow wall is metered so that it will fill the interior of the wall when the fluid is frozen, i.e., it goes through a change of phase where expansion occurs. The fluid can be charged into the wall at an elevated temperature of about 100-125 F to create a slight vacuum within the wall, at room temperature. This will reduce or eliminate gas pressure build-up when the fluid freezes and expands.

The toroidal closure for the sleeve insert includes sealing and retaining rings which snap into receiving grooves in the hollow wall. Once the toroidal closure is in position, the chill fluid held in the hollow wall of the insert remains encapsulated.

The chill sleeve is inserted through the open bottom of the cylinder (cylindrical wall) until it stops because of "press-fit" conditions wherein the sleeve insert is frictionally wedged into the inner face of the cylindrical wall. Friction between the inside face of the cylinder and the outside face of the sleeve insert will hold the sleeve insert permanently in place. To assure that the sleeve insert does not thereafter move, even with repeated heating and cooling, sealing and retaining rings in the outside face of the sleeve insert are used to engage receiving grooves in the inside face of the cylinder wall.

The cylinder wall (cylindrical wall) is closed-off at its bottom after the sleeve insert is in place. This bottom closure is a hollow disk having a permanent top wall (top face) attached to a tapered side wall and a separate snap-in bottom wall (bottom face). The bottom closure, being a hollow disk, is also charged with chill fluid at an elevated temperature, wherein the procedure is like charging the sleeve insert. Again, the volume of fluid charged into the bottom closure is metered to take into consideration expansion upon freezing. Once charged, the bottom wall (bottom face) of the bottom closure is snapped into place to encapsulate the chill fluid. Retaining and sealing rings are utilized between the inside face of the tapered side wall and the snap-in bottom wall (bottom face).

The charged and assembled bottom closure is then snapped into the bottom lip of the cylinder (cylindrical wall). Retaining and sealing rings are utilized between the outside face of the tapered sidewall and the inside face of the tapered cylinder (cylindrical wall).

As an alternative to retaining and sealing rings, sonic welding can be used to permanently join and/or bond mating surfaces.

With a chill fluid of ordinary water, a 9-10 percent expansion upon freezing is calculated. Depending upon the purity of distilled water, and/or the characteristics of any food additives, a 10-11.5 percent expansion upon freezing is calculated.

The freezing point of ordinary water is about 32 F. The freezing point of distilled water can be as low as 28 F. With either of these two chill fluids, a visual indication of chill fluid temperature will be evident only at about the change of phase transition, i.e., changing from a solid to a liquid. Adding a food coloring to ordinary water can provide a stronger visual indication of frozen and liquid states. However, any addition of any substances to distilled water will change its chemistry and its freezing point. The addition of a few drops of olive oil to ordinary water and the use of an FDA approved emulsifier will produce a chill fluid with visual indicators of temperature as it goes from the oil congealing to freezing, in a temperature range of about 33-43 F. In the alternative, a color temperature strip can be glued to the outside face of the cylinder to indicate temperature.

A spiral tower can be positioned in the middle of the beverage container, i.e., the cylindrical wall member, and attached to the inside (top) face of the bottom closure. This spiral tower is ribbon-shaped, or tubular shaped, and charged with chill fluid. The position of this spiral tower in the middle of the cylindrical member promotes mixing when a beverage is poured into the container.

A mouthpiece can be inserted onto the top lip of the container. This mouthpiece covers the entire top of the container and can inhibit beverage being spilled. A cover cap can be positioned over the mouthpiece.

BRIEF DESCRIPTION OF THE DRAWINGS

The features, advantages and operation of the present invention will become readily apparent and further understood from a reading of the following detailed description with the accompanying drawings, in which like numerals refer to like elements, and in which.

DETAILED DESCRIPTION OF THE INVENTION

The present invention is thermoplastic beverage container in the shape of a glass, a mug, a cup, or a pitcher, which has hollow members containing a chilling fluid, usually frozen water, i.e., ice. Ordinary water normally freezes, i.e., turns into ice, at 32 F. Beverages for American taste are often considered best when served "ice cold". Ice cold, however, means a different temperature for different and various types of beverages. Beers, wine, soft drinks, juices, milk, and water may all be served at different ideal ice-cold temperatures. Typically, the temperature range for serving beverages extends from about 40 F to about 60 F. In this temperature range, ice chilling or ice-melt chilling is quite satisfactory.

A chilled beverage begins to warm once it is poured into a beverage container. Chilling the beverage container prior to serving the drink only keeps the beverage chilled for a short period of time. To keep the beverage cool longer ice cubes could be added to the beverage. This, however, results in a "watered-down" drink. The present invention encapsulates the ice within cavities in the drinking container itself, thereby eliminating any watering-down.

Figure 1:
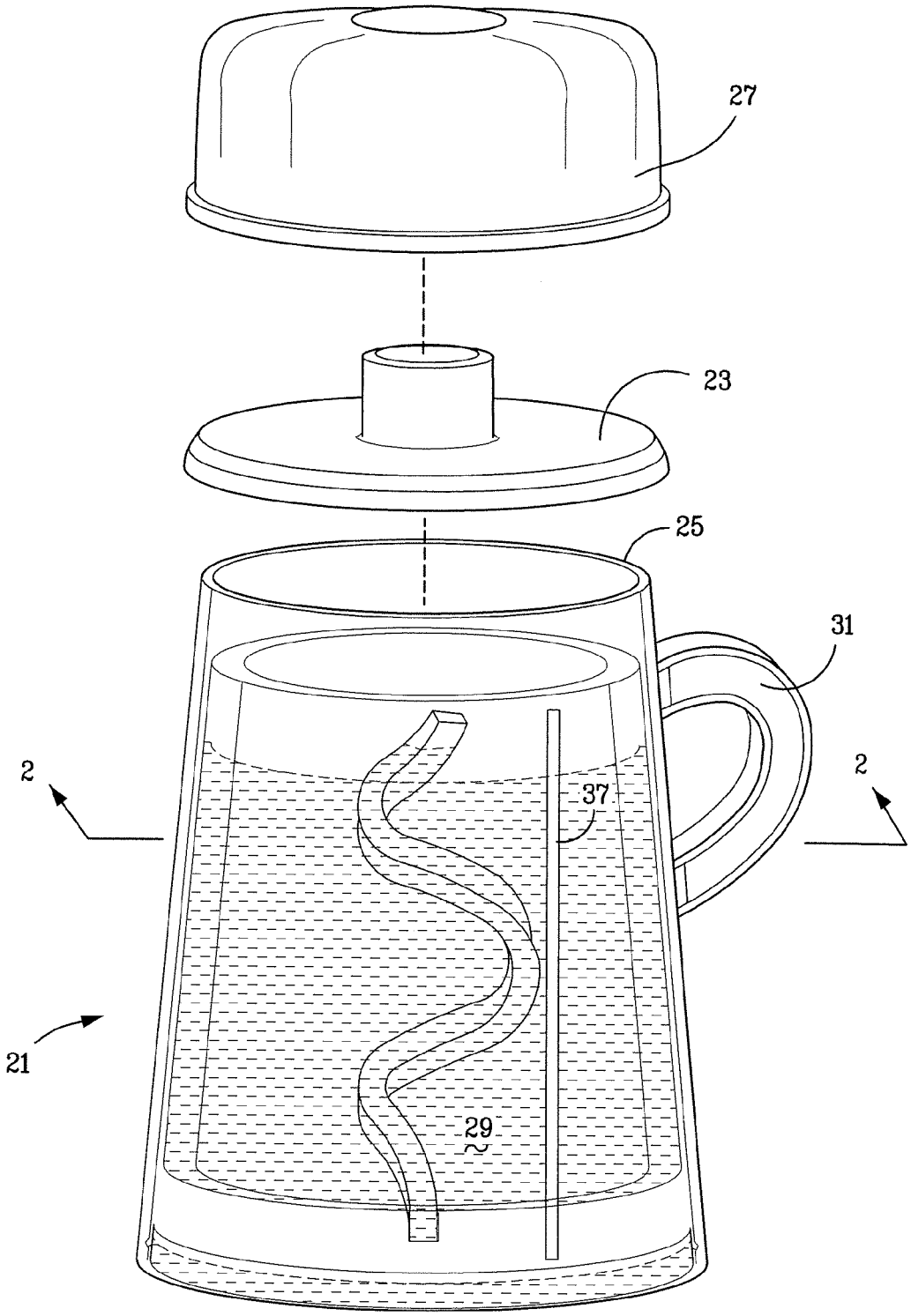
FIG. 1 is a perspective, side view of the beverage container of the present invention with the mouthpiece and cover cap separated from the body of the container.

The thermoplastic beverage container, FIG. 1, includes a body 21, a mouthpiece 23 which can be inserted into the top or lip 25 of the body 21, and a cap 27 which can fit over the mouthpiece 23. Both the mouthpiece 23, which intended to keep the beverage from spilling, and the cap 27, which is intended to keep the mouthpiece clean, are optional accessories to the invention.

The body 21, has is cylindrically shaped having a cylindrical wall 29 which is tapered, outward, at an angle selected in the range of about 3-5 degrees from vertical. The cylindrical wall has a linear surface from top to bottom. Thus the bottom has a larger diameter than the top (lip). A handle loop is attached to the cylindrical wall when the container is constructed for use as a mug, cup or pitcher. The container body 21 has a hollow bottom (bottom closure) 33 and includes a hollow chill sleeve insert 35. Both the hollow insert 35 and the hollow bottom 33 enclosure are charged with, i.e., they encapsulate, a quantity of chill fluid, such as water. Each are shown in outline in FIG. 1. A color temperature strip 37 can be mounted on the outside of the body 21 by gluing or other attachment. This temperature indicating strip 37 extends vertically along the outside of the container's cylindrical wall 29.

Figure 2:
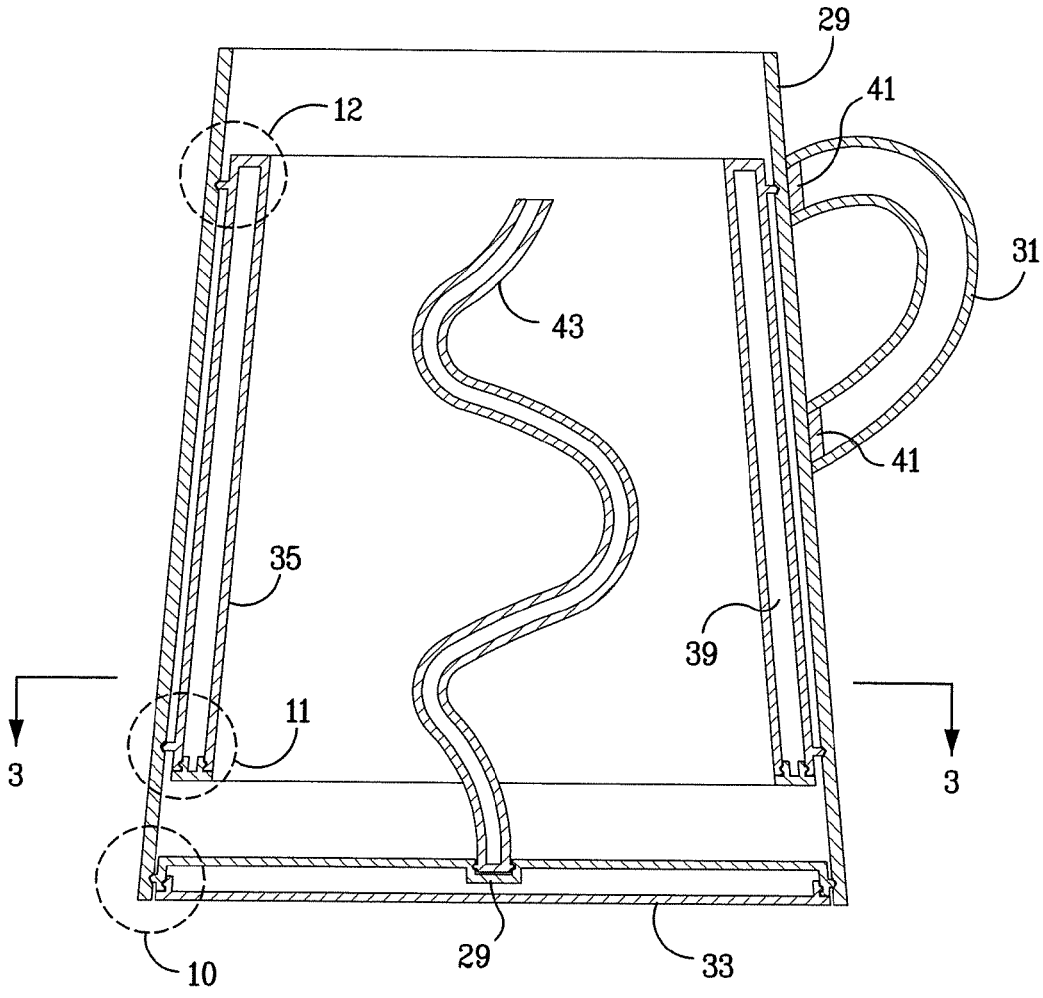
FIG. 2 is a vertical, cross-sectional view of the container, taken as shown in FIG. 1.

The cylindrical wall 29 of the container's body 21 is a solid wall of uniform thickness, FIG. 2. This cylindrical wall 29 is made of clear (transparent) plastic. Or alternatively, can be somewhat opaque (lightly frosted). The plastic is relatively rigid such as high density polyethylene (HDPE) or polyvinyl chloride (PVC). The cylindrical wall 29 is frustoconical-shaped, as a truncated cone, and is open at either end. The bottom of the cylindrical wall 29 is closed off with the bottom closure structure 33 to form the container.

The hollow sleeve insert 35 is also frustoconical-shaped with a top opening and a bottom opening and a wall taper identical to the taper of the cylindrical wall 29, FIG. 2. The hollow bottom closure 33 is disk-shaped with an edge wall (edge face) 55 tapered to suit the taper of the cylindrical wall 29. The top and bottom faces 51, 53 of the bottom closure 33 extend in parallel to each other. The inside and outside faces of the hollow insert 35 extend in parallel. Water 39 is encapsulated within the cavity of the hollow bottom closure 33 and the cavity of the hollow sleeve insert 35 under a slight vacuum. The quantity of water held in each of the hollow bottom closure 33 and hollow sleeve insert 35 is such that when it expands upon freezing it about fills the hollow space in each structure. The slight vacuum at room temperature reduces the likelihood of gas pressure build-up upon the water freezing.

The handle 31 is hollow to reduce temperature transfer between the container and the hand of a person grasping the handle. Insulation pads 41 positioned at the mounting point of the handle to the outside face of the cylindrical wall 29 further reduce the temperature transfer between the handle 31 and the cylindrical wall 29 of the container.

The sleeve insert 35 position in the container body 21 on the inside face of the cylindrical wall 29 is above and away from the bottom 33 a distance of about ⅛ to ⅜ inches. The top of the sleeve insert 35 is about 1 inch below the top lip of the cylindrical wall 29, with the insert 35 extending along the entire body between those two measurements.

Ordinary water expands about 9-10% upon freezing. Thus, when water is encapsulated in any of the hollow members of the present invention, a "head-space" for about 9-10% expansion is provided. That "head-space" would typically be filled with air. Without a partial vacuum, as the water begins to freeze, it will begin to expand. With this expansion, the air in the "head-space" will be compressed. A gas pressure build-up will occur. With such an increase in pressure, the freezing point (freezing temperature) of the water 39 will change. The freezing point will be lowered. This is an undesirable event.

However, if a partial vacuum is created in an encapsulation chamber, the pressure above the water will not increase significantly as the water expands to freeze. Under a partial vacuum, a certain number of water molecules will evaporate into the "head space" above the water when the water is at room temperature. As the encapsulation cavity is cooled, the water molecules in the "head-space" will go back into solution. water is cooled and is being frozen and begins to expand, the water molecules in the head space will go back into solution. As the water begins to freeze and expand, there will be little gas pressure increase in the "head-space". Thus the water freeze at about 32 F.

Thus, the water is metered into each hollow member of the invention which encapsulates the fluid. The water is charged at an elevated temperature of about 100-125 F. This expands the "head-space" air prior to sealing the encapsulation space. After the encapsulation space is sealed and the water cools a slight negative pressure is created within each sealed encapsulation, i.e., a slight vacuum is created. This is enough to keep the freezing temperature of the water at about 32 F.

Figure 3:
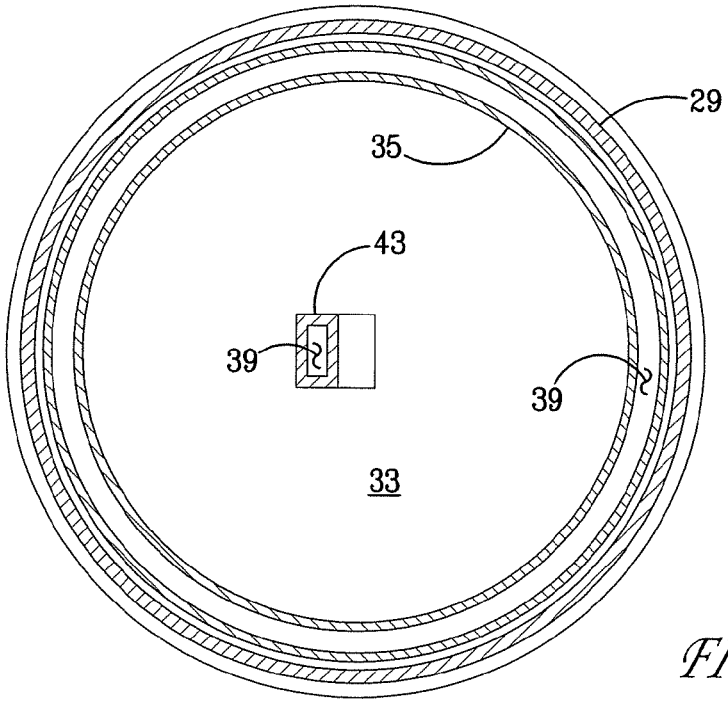
FIG. 3 is a horizontal, cross-sectional view of the container, taken as shown in FIG. 1.

FIG. 3 shows a horizontal cross-section through the container at about its mid-height. The sleeve insert 35 seats flush against the inside face of the cylindrical wall 29. Also seen extending upwardly from the center of the bottom closure 33 is a hollow spiral tower 43. The spiral tower 43 and the sleeve insert 35 each encapsulate a quantity of the chill fluid water 39.

Figure 4:
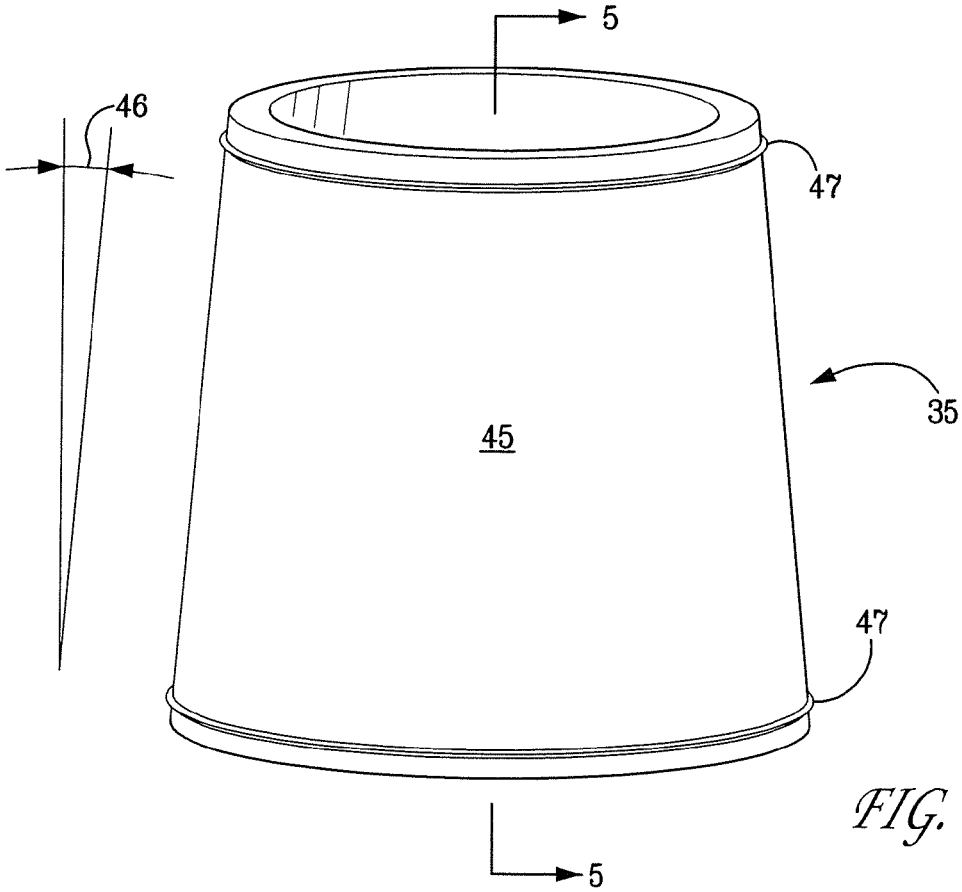
FIG. 4 is a perspective, side view of the chill sleeve insert.
Figure 5:
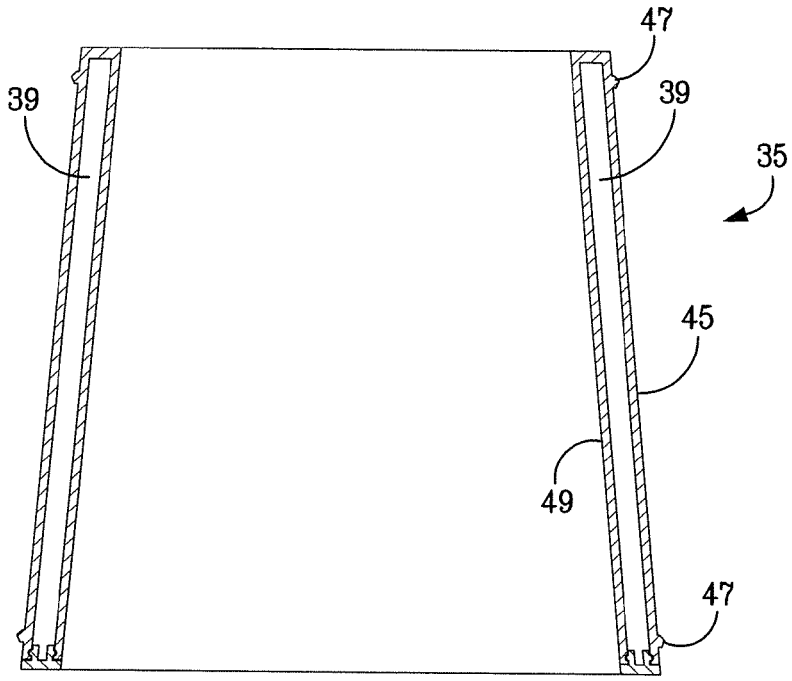
FIG. 5 is a vertical, cross-sectional view of the chill sleeve insert, taken as shown in FIG. 4.

The chill sleeve insert 35, being a hollow-walled cylinder is shown in FIGS. 4 and 5. The sleeve insert outer face 45 is tapered outwardly from the vertical at an angle 46 equal to the taper angle of the cylindrical wall 29. This angle is chosen in the range of 3-5 degrees which permits the sleeve insert 35 to be inserted through the open bottom of the cylindrical wall 29 into a press-fit against the inside face of the cylindrical wall 29. The inside face 49 and the outside face 45 of the hollow sleeve insert 35 extend parallel to one another.

A pair of retaining and sealing rings 47 extend annularly about the outside face 45 of the sleeve insert 35, with one being located proximate the top of the insert 35 and the other being proximate the bottom of the insert 35. These retaining and sealing rings 47 are each made of an electrometric plastic material, such as TPE, TPV, and Styroflex® (BASF Corporation).

Figure 6:
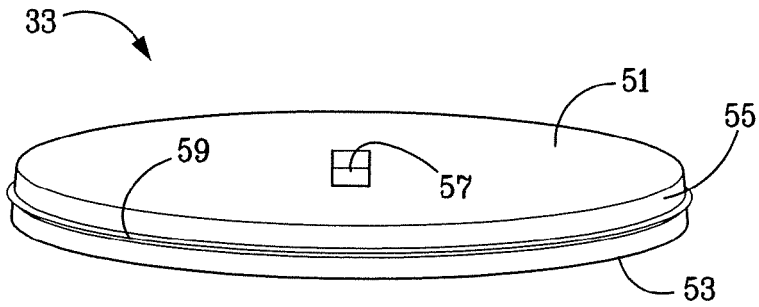
FIG. 6 is a perspective, side view of the bottom closure to the container.
Figure 7:
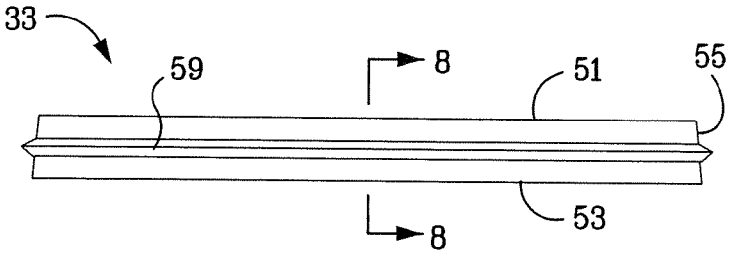
FIG. 7 is a side view of the bottom closure of FIG. 6.
Figure 8:
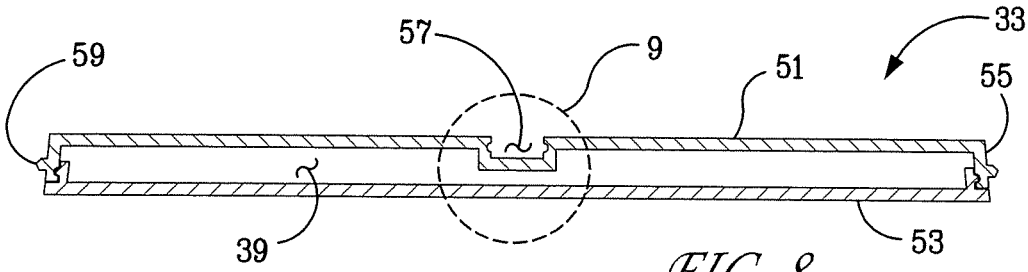
FIG. 8 is a vertical, cross-sectional view of the bottom closure, taken as shown in FIG. 7.

The hollow container's bottom closure 33, FIGS. 6-8, is disk-shaped with a top face 51 and a bottom face 53 and a tapered side face (outside edge) 55. The top face 51 has a receiving slot 57 at its center for holding the spiral tower 43 upright. The bottom face 53 is insertable by snapping into the inside edge of the side face 55, described further below. In order to be held on the inside face of the cylindrical wall 29 the bottom 33 has an annular retaining and sealing ring 59 about the outside of its sidewall 55. Water 39 is encapsulated within the hollow bottom 33 when the bottom face 53 is snapped into place.

Figure 9:
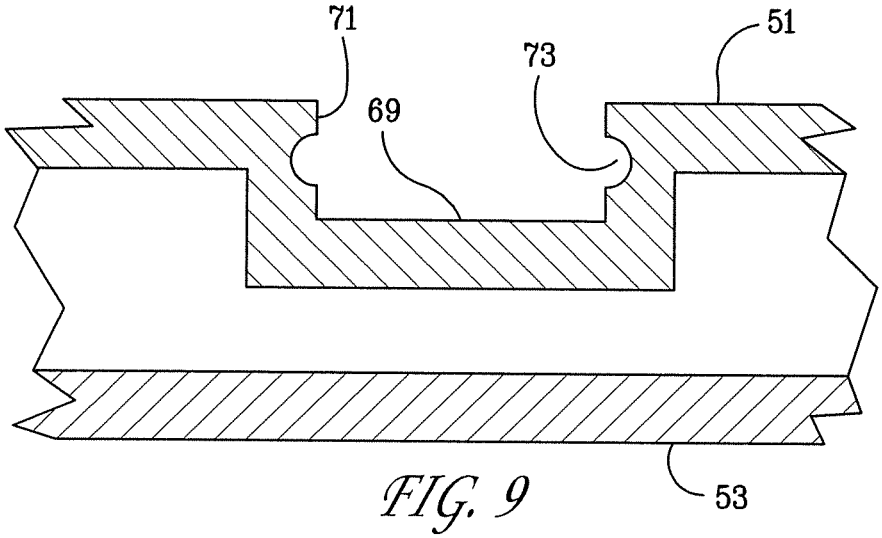
FIG. 9 is a partial, vertical cross-sectional view of the spiral tower receiving socket positioned in the top face of the bottom closure, taken as shown in FIG. 8.

The slot 57 in the top face 51 of the bottom closure is shown in cross-sectional detail in FIG. 9. This slot has a flat bottom 69 and straight, vertically extending walls 71. The longer sidewalls 71 each have a receiving groove 73.

Figure 10:
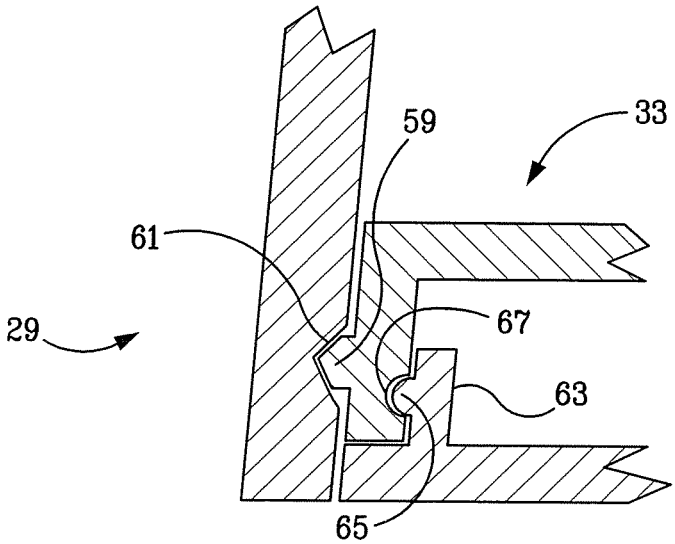
FIG. 10 is a partial, vertical cross-sectional view of the bottom closure joined to the bottom lip of the cylindrical wall with the bottom closure assembled with its snap-in bottom face, taken as shown in FIG. 2.

The connection of the bottom closure 33 to the cylindrical wall 29 is shown in FIG. 10. The annular sealing and retaining ring 59 on the bottom closure 33 engages an annular receiving groove 61 on the inside face of the cylindrical wall 29. The bottom face 53 of the bottom closure 33 includes and upstanding finger 63 which may be circular of a plurality of tabs. This finger carries an annular projection 65 which engages a groove 67 on the inside of the side face 55. The finger 63 is flexible and inserts a pressure against the inside of the side face 55 with sufficient force to maintain the negative pressure within the encapsulating wall of the bottom 33.

Figure 11:
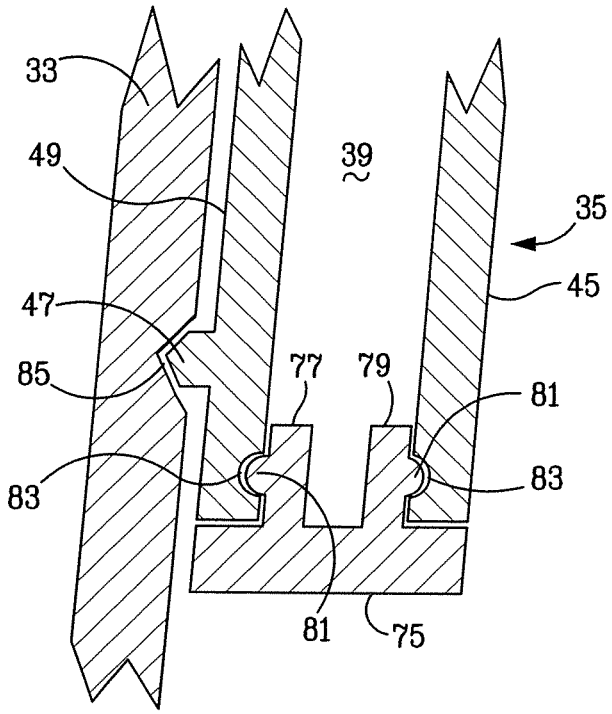
FIG. 11 is a partial, vertical cross-sectional view of the bottom of the chill sleeve insert assembled with its toroidal-shaped bottom closure in place and the insert in place against the inside face of the cylinder, taken as shown in FIG. 2.

The hollow wall of the sleeve insert 35 has a toroidal-shaped bottom wall 75 closure, FIG. 11, closing off the water 39 encapsulation space between the sleeve 35 outer face 45 and inner face 49. This bottom wall has a pair of inwardly extending fingers 77, 79, which may be a series of tabs or annular fences, each carrying a respective outer-facing sealing and retaining ring 81. Each engages an inwardly facing receiving groove in the inside of the inner and outer faces 45, 49 of the insert 35. Again the pressure between these structures 81, 83 is sufficient to seal the encapsulating space within the wall cavity of the sleeve insert 35.

Figure 12:
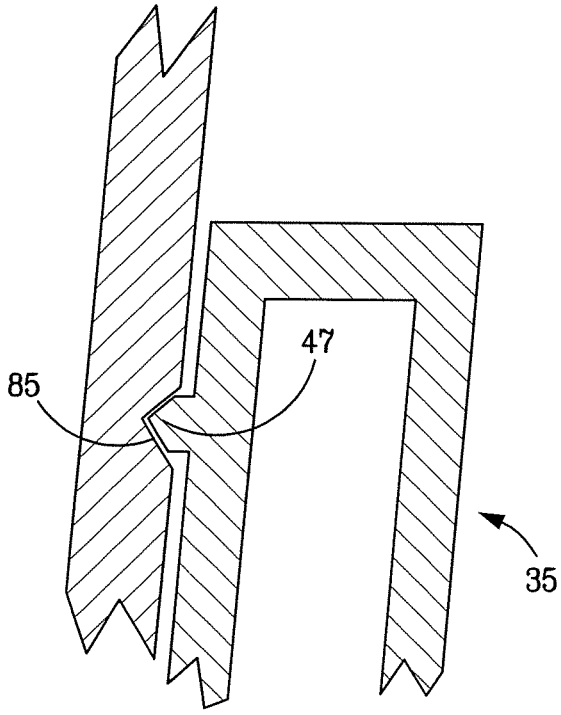
FIG. 12 is a partial, vertical cross-sectional view of the top of the chill sleeve insert in place against the inside face of the cylinder, taken as shown in FIG. 2.

The top and bottom annular sealing and retaining rings 47 on the outside face 49 of the sleeve insert 35 are shown engaging respective top and bottom receiving grooves 85 in FIGS. 11 and 12.

Figure 13:
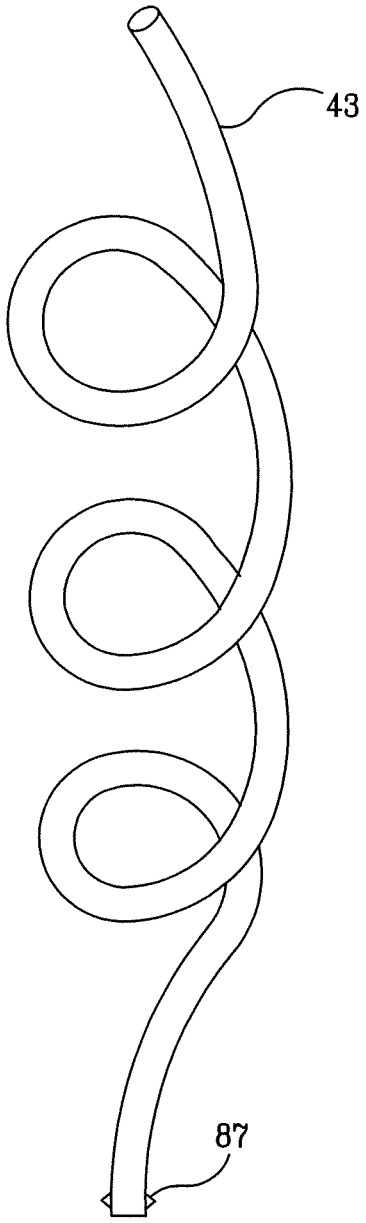
FIG. 13 is a perspective, side view of the hollow spiral tower which is inserted into the top face of the bottom closure of FIG. 8, having a rectangular cross-sectional shape.
Figure 14:
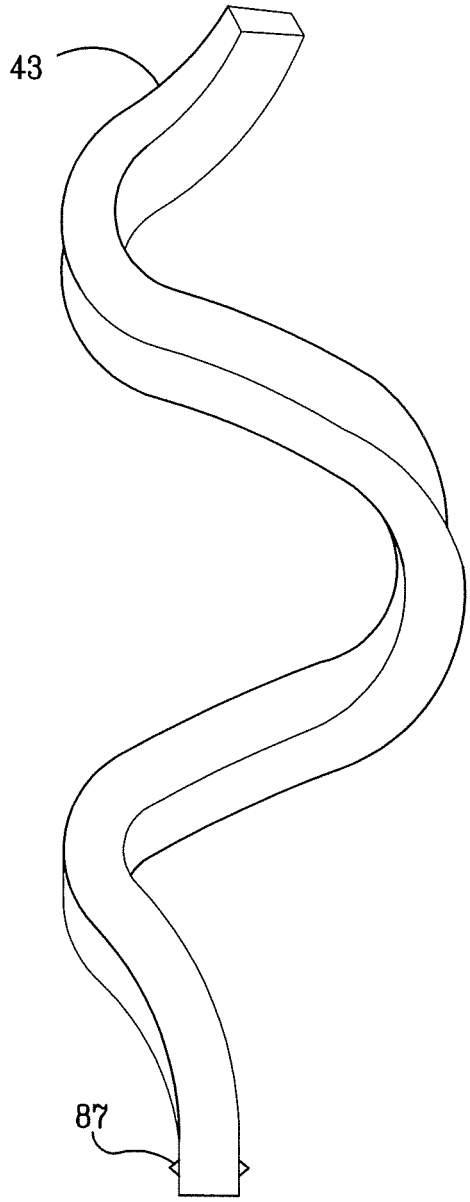
FIG. 14 is a perspective, side view of the hollow spiral tower having a circular cross-sectional shape.

The hollow spiral tower 43 can either have a ribbon shape with a rectangular cross-section, FIG. 13, or a tubular shape with a circular cross-section, FIG. 14. In either instance the wall of the spiral tower 43 carries a pair of detents 87 which engage the slot wall groove 73 of the slot 57 in the top face 51 on the bottom closure 33. The hollow spiral tower 43 is first sealed at its lower end, then charged with water chill fluid 39 in the heated state, and then the top end is sealed. The spiral tower 43 is made of any of the plastic materials recited above for the cylindrical wall 29, the bottom closure 33 and the sleeve insert 35.

Many changes can be made in the above-described invention without departing from the intent and scope thereof.

For example, alternatively, the bottom 33 and the chill sleeve insert 35 can each be molded as complete hollow enclosures with a fill port. This port can be plugged once the fluid is charged in the enclosures. Further, the slight vacuum can be created in alternative methods. Such as, filling a hollow enclosure and then extracting a portion of the fluid to create the vacuum. Alternatively, a hollow enclosure can first be heated with a very warm gas or steam, the fluid charged, and the hollow enclosure sealed. As it cools the vacuum will be created.

It is therefore intended that the above description be read in the illustrative sense and not in the limiting sense. Substitutions and changes can be made while still being within the scope and intent of the invention and of the appended claims.

What is claimed is:

1. A container for chilling a beverage held therein, comprising:

a body having a cylindrical wall with a top lip and a bottom lip openings and an inner and outer faces, said body holding the beverage;

a bottom which is hollow and encapsulates a chill fluid;

a hollow sleeve insert positioned within said body against said cylindrical wall inner face and positioned above as spaced away from said bottom;

wherein said hollow sleeve insert encapsulates a chill fluid;

wherein said chill fluid within said bottom and within said sleeve insert freezes at a temperature of 32 F or below and wherein said chill fluid expands upon freezing;

wherein said cylindrical wall is frustoconical-shaped with its larger diameter at its bottom;

wherein said hollow sleeve insert is frustoconical-shaped with a top and bottom openings and its larger diameter at its bottom;

wherein said hollow sleeve insert position against said cylindrical wall is by friction press-fit; and wherein said cylindrical wall inner face carries a plurality of receiving grooves proximate said hollow sleeve insert position, and wherein said hollow sleeve insert outer face carries a plurality of retaining and sealing rings wherein a respective ring of said insert engages a respective groove of said cylindrical wall.

2. A container of claim 1, wherein said chill fluid within said bottom and within said sleeve insert freezes at a temperature in the range of about 28 F to about 32 F;

wherein said hollow bottom is frustoconical-shaped with its larger diameter at its bottom; and wherein said hollow bottom and said hollow sleeve insert hold said chill fluid charged there into and each then being sealed, said chill fluid being subjected to a negative pressure, being a partial vacuum, when at room temperature.

3. The container of claim 1, wherein said cylindrical wall inner face carries at least one receiving groove proximate the position of said bottom and wherein said bottom side wall carries at least one retaining and sealing ring wherein said ring engages said groove.

4. The container of claim 1, wherein said cylindrical wall is of solid thermoplastic material selected from the group of HDPE and PVC, wherein said hollow sleeve insert is of thermoplastic material selected from the group of PETE and LDPE and wherein said hollow bottom is of thermoplastic material selected from the group of HDPE and PVC.

5. The container of claim 1, also including a color temperature strip attached to said cylindrical wall outer face.

6. The container of claim 5, wherein said temperature strip extends vertically.

7. The container of claim 1, also including a hollow spiral tower positioned within said container extending upwardly from the center of the container's bottom, said tower containing said chill fluid encapsulated under a negative pressure at room temperature and below.

8. The container of claim 7, wherein the volume of chill fluid encapsulated in said hollow sleeve insert, in said container's hollow bottom, and in said hollow spiral tower is metered to account for expansion upon freezing so that the encapsulation space is essentially filled upon said expansion.

9. The container of claim 7 wherein the top face of said containers hollow bottom includes a socket for holding said hollow spiral tower.

10. The container of claim 1, wherein the containers cylindrical wall, the bottom and the hollow sleeve insert are joined by sonic welding.

11. The container of claim 1, also including a handle mounted on said cylindrical wall outer face, said handle being thermally isolated from said cylindrical wall by insulation pads at its mounting.

12. The container of claim 2, wherein said chill fluid is water and wherein said negative pressure is the result of said water being charged at an elevated temperature.

13. The container of claim 12, wherein said charged water elevated temperature is about 100 F to 125 F.

14. The container of claim 12, wherein said water charge has been metered to take into consideration said expansion upon freezing.

15. The container of claim 14, wherein said hollow sleeve insert bottom wall is toroidal-shaped and wherein said hollow sleeve insert has a solid top extending between the inner and outer faces and an insertable bottom wall.

16. The container of claim 1, wherein said freeze expansion is between about 9 percent and 11.5 percent.

17. The container of claim 16, wherein said hollow sleeve insert position against said cylindrical wall is by friction press-fit.

18. The container of claim 1, wherein said body holds said beverage in direct contact with the surface thereof;

said hollow sleeve insert extending the height of said side wall except for a space below said top lip opening and a space above said bottom, whereby said sleeve insert is spaced away from both said top lip and said bottom;

wherein said chill fluid is charged into and encapsulated within said hollow sleeve insert and said hollow bottom;

wherein said encapsulation is gas and fluid leak resistant; and wherein said encapsulated chill fluid is subject to a negative pressure-partial vacuum when in the fluid state.

19. The container of claim 18 wherein said negative pressure-partial vacuum is the result of charging said chill fluid at an elevated temperature.

20. The container of claim 18 wherein said negative pressure-partial vacuum is the result of charging said chill fluid at a temperature in the range of about 100 F to about 125 F.

* * * * *

UNITED STATES PATENT AND TRADEMARK OFFICE

CERTIFICATE OF CORRECTION

PATENT NO. : 8,439,221 B2
APPLICATION NO. : 12/946264
DATED : May 14, 2013
INVENTOR(S) : Troy M. Davis It is certified that error appears in the above-identified patent and that said Letters Patent is hereby corrected as shown below:

In the Claims:

Column 8, line 20, reads "containers hollow bottom includes a socket for holding said"
should read -- container's hollow bottom includes a socket for holding said --

Column 8, line 22, reads "10. The container of claim 1, wherein the containers cylin-"
should read -- 10. The container of claim 1, wherein the container's cylin- --

Signed and Sealed this
Twenty-fifth Day of June, 2013

Teresa Stanek Rea
*Acting Director of the United States Patent and Trademark Office*